US009444199B2

(12) United States Patent
Leng et al.

(10) Patent No.: US 9,444,199 B2
(45) Date of Patent: Sep. 13, 2016

(54) FEMALE CONNECTOR FOR HIGH-SPEED TRANSMISSION WITH GROUNDING

(71) Applicant: BizConn International Corp., Guangdong Province (CN)

(72) Inventors: Qiang Leng, Guangdong Province (CN); Hong-Guang Kuang, Guangdong Province (CN); Jia-Mao Zheng, Guangdong Province (CN)

(73) Assignee: BizConn International Corp., Guangdong Province (CN)

( * ) Notice: Subject to any disclaimer, the term of this patent is extended or adjusted under 35 U.S.C. 154(b) by 0 days.

(21) Appl. No.: 14/735,149

(22) Filed: Jun. 10, 2015

(65) Prior Publication Data

US 2016/0064871 A1 Mar. 3, 2016

(30) Foreign Application Priority Data

Sep. 2, 2014 (CN) ..... 2014 2 0500190

(51) Int. Cl.

*H01R 13/648* (2006.01)
*H01R 24/60* (2011.01)
*H01R 13/6596* (2011.01)
*H01R 107/00* (2006.01)

(52) U.S. Cl.

CPC ..... *H01R 24/60* (2013.01); *H01R 13/6596* (2013.01); *H01R 2107/00* (2013.01)

(58) Field of Classification Search

CPC ..... H01R 13/514; H01R 13/65807; H01R 23/005; H01R 23/688; H01R 23/7073
USPC ..... 439/607.05, 607.28, 660
See application file for complete search history.

(56) References Cited

U.S. PATENT DOCUMENTS 4,943,244 A * 7/1990 Teck ..... H01R 12/716 439/567
5,257,949 A * 11/1993 Paulus ..... H01R 13/7197 333/185
5,961,348 A * 10/1999 Murphy ..... H01R 4/023 439/108
6,537,086 B1 * 3/2003 Mac Mullin ..... H01R 23/688 439/79
6,735,308 B1 * 5/2004 Illg ..... H01R 13/514 379/438
6,863,543 B2 * 3/2005 Lang ..... H01R 13/514 439/607.05
7,316,584 B2 * 1/2008 Mackillop ..... H01R 13/6477 439/607.05
7,462,071 B1 * 12/2008 Wu ..... H01R 9/032 439/497
7,682,192 B2 * 3/2010 Sawdy ..... H01R 13/514 439/607.05

(Continued)

FOREIGN PATENT DOCUMENTS

CN 202817398 U 3/2013

*Primary Examiner* — Abdullah Riyami
*Assistant Examiner* — Vladimir Imas
(74) *Attorney, Agent, or Firm* — CKC & Partners Co., Ltd.

(57) ABSTRACT

Provided is a female connector for high-speed transmission with grounding, including a case, an insulating body, and an upper terminal group and a lower terminal group disposed in the insulating body. The insulating body is disposed in the case. A shielding sheet is disposed in the insulating body. A contact part directly processed from the shielding sheet is disposed on a portion of the shielding sheet, wherein the portion corresponds to the ground terminals of the upper terminal group and the lower terminal group. The contact part is physically and electrically connected to the ground terminals. The upper terminal group and/or the lower terminal group at least includes a high frequency terminal pair, wherein the thickness of a contact portion of the high frequency terminal pair is less than the thickness of a portion adjacent to the contact portion.

10 Claims, 5 Drawing Sheets

(56) References Cited

U.S. PATENT DOCUMENTS 7,909,653 B1 * 3/2011 Wan ..... H01R 13/514 439/660
7,972,181 B1 * 7/2011 Zhu ..... H01R 12/724 439/660
8,475,216 B2 * 7/2013 Tung ..... H01R 13/506 439/607.4
8,480,435 B2 * 7/2013 Hsiao ..... H01R 13/6658 439/660
8,668,524 B2 * 3/2014 Lan ..... H01R 12/724 439/607.35
8,678,853 B2 * 3/2014 Tai ..... H01R 12/675 439/404
8,684,769 B2 * 4/2014 Kao ..... H01R 13/6471 439/607.28
8,808,029 B2 * 8/2014 Castillo ..... H01R 13/6585 439/607.05
8,961,235 B2 * 2/2015 Little ..... H01R 13/64 439/374
9,172,174 B2 * 10/2015 Tsai ..... H01R 13/516
9,281,643 B1 * 3/2016 Tseng ..... H01R 24/78
2002/0061669 A1 * 5/2002 Yu ..... H01R 13/65802 439/95
2009/0042450 A1 * 2/2009 Zheng ..... H01R 23/6873 439/660
2009/0258539 A1 * 10/2009 Zheng ..... H01R 13/65802 439/607.41
2010/0136830 A1 * 6/2010 Chen ..... H01R 13/504 439/607.01
2015/0244111 A1 * 8/2015 Ju ..... H01R 13/6585 439/607.05

* cited by examiner

FEMALE CONNECTOR FOR HIGH-SPEED TRANSMISSION WITH GROUNDING

RELATED APPLICATIONS

This application claims priority to Chinese Patent Application Serial Number 201420500190.9, filed on Sep. 2, 2014. The entirety of the above-mentioned application is hereby incorporated by reference and made a part of this specification.

BACKGROUND

1. Field of Invention

The present invention relates to a female connector, and more particularly, to a female connector for high-speed transmission with good grounding.

2. Description of Related Art

The structure of a connector in prior art includes an insulating body, a shielding case covering on the insulating body, and a terminal group. Shielding of the connector is achieved by connecting the shielding case and a ground terminal. China Patent reference CN 202817398 U discloses a USB 3.0 socket connector including a shielding case, an insulating tongue mounted inside the shielding case, and conductive terminal groups mounted on the insulating tongue, in which the conductive terminal groups include a first conductive terminal group and a second conductive terminal group. The first conductive terminal group includes two pairs of signal terminals and a ground terminal. The shielding case is electrically connected to the ground terminal. As a connecting piece extending from the rear end of the shielding case is connected with the ground terminal, the shielding case and the ground terminal are grounded simultaneously, thereby enhancing the shielding effect of the connecting wiring.

In the above-mentioned USB 3.0 socket connector, a connecting piece extending from the rear end of the shielding case and the ground terminal are connected and grounded simultaneously so as to reduce the electromagnetic interference from the environment to interfere the connector, as well as to prevent the signal of the connector from interfering the external environment. However, this structure fails to reduce the electromagnetic interference inside the connector. In particular, the connector includes an upper terminal group and a lower terminal group. Due to the small spacing between the terminal groups and the varieties of terminal types responding for their numerous functions, when a high frequency terminal exists or a large current is to be passed, the connector generally fails to function normally because of the large signal interference and the excessive ineffective current. Accordingly, the conventional connector of which a connecting piece extending from the shielding case is connected to the ground terminal cannot reduce the internal electromagnetic interference generated by the terminal groups inside the connector, and the grounding effect is also unsatisfactory.

SUMMARY

Accordingly, it is an object of the present invention to provide a female connector for high-speed transmission, having good grounding effect, and capable of attaining superior shielding effect for the terminal groups inside of the connector.

The technical solution of the present invention is to design a female connector for high-speed transmission with grounding. The female connector includes a case, an insulating body, and an upper terminal group and a lower terminal group disposed in the insulating body. The insulating body is disposed in the case. A shielding sheet is disposed in the insulating body. A contact part directly processed from the shielding sheet is disposed on a portion of the shielding sheet, wherein the portion corresponds to the ground terminals of the upper terminal group and the lower terminal group. The contact part is physically and electrically connected to the ground terminals.

As a further improvement for the above-mentioned technical solution, the contact part includes an upper spring plate and/or a lower spring plate. The upper spring plate is physically and electrically connected to the upper ground terminal of the upper terminal group. The lower spring plate is physically and electrically connected to the lower ground terminal of the lower terminal group.

As a further improvement for the above-mentioned technical solution, the insulating body includes an upper insulating body, a middle insulating body, and a lower insulating body. The upper terminal group is disposed on the upper insulating body. The lower terminal group is disposed on the lower insulating body. The shielding sheet is disposed in the middle insulating body. The upper insulating body and the lower insulating body are engaged with the middle insulating body to form an integrated device.

As a further improvement for the above-mentioned technical solution, the insulating body includes an upper insulating body and a lower insulating body. The upper terminal group is disposed on the upper insulating body. The lower terminal group is disposed on the lower insulating body. The shielding sheet is disposed between the upper insulating body and the lower insulating body. The upper insulating body and the lower insulating body are engaged to form an integrated device.

As a further improvement for the above-mentioned technical solution, the insulating body is integrally formed, and the shielding sheet is inserted into the insulating body.

As a further improvement for the above-mentioned technical solution, a first shielding engaging case and a second shielding engaging case are further included. A first hook is disposed on the first shielding engaging case. A second hook is disposed on the second shielding engaging case. A first hooking portion and a second hooking portion are disposed on the upper surface and the lower surface of the middle insulating body, respectively. The first shielding engaging case is engaged with the upper surface of the middle insulating body, wherein the first hook interlocks the corresponding second hooking portion on the middle insulating body. The second shielding engaging case is engaged with the lower surface of the middle insulating body, wherein the second hook interlocks the corresponding first hooking portion on the middle insulating body.

As a further improvement for the above-mentioned technical solution, the upper terminal group and/or the lower terminal group at least includes a high frequency terminal pair, wherein the thickness of a contact portion of the high frequency terminal pair is less than the thickness of a portion adjacent to the contact portion.

As a further improvement for the above-mentioned technical solution, a rib is disposed around the case.

In the present invention, the connector has a structure in which a shielding sheet is disposed in the insulating body, and a contact part directly processed from the shielding sheet is disposed on a portion of the shielding sheet, the portion corresponding to the ground terminals of the upper terminal group and the lower terminal group, wherein the contact part contacts the ground terminals. Accordingly, when the connector operates, the shielding sheet between the upper terminal group and the lower terminal group can reduce the electromagnetic interference between the terminal groups, thereby assuring the normal signal transmission and current transport for the terminal groups. In addition, the contact part of the shielding sheet contacts with the ground terminal to form an infinite ground, so that the ineffective current or noise can be conducted away. Furthermore, elements in the grounded shielding body are prevented from being interfered by the exterior electromagnetic field. Safety is guaranteed even if a large current flows into the connector. Therefore, the present invention has advantage in that a superior shielding and a good grounding effect can be realized for the terminal groups inside of the connector.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
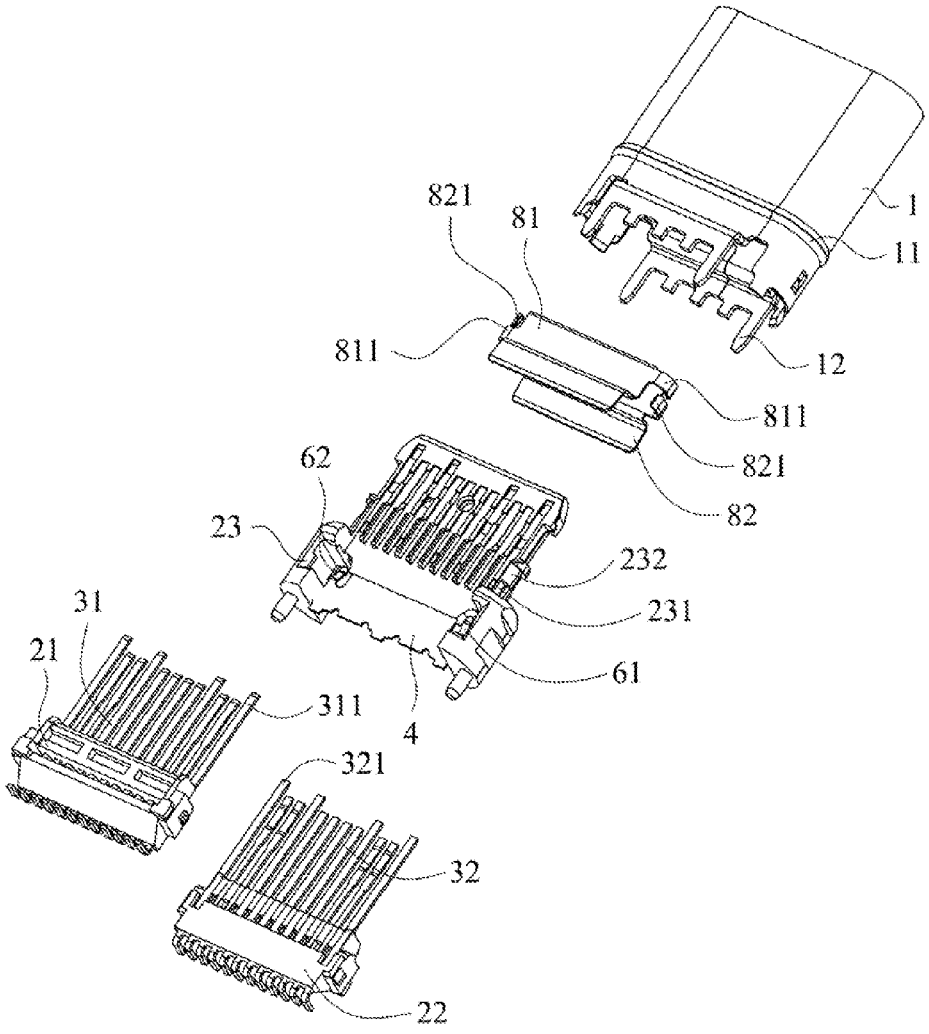
FIG. 1 is a schematic exploded view of an embodiment of the present invention.
Figure 2:
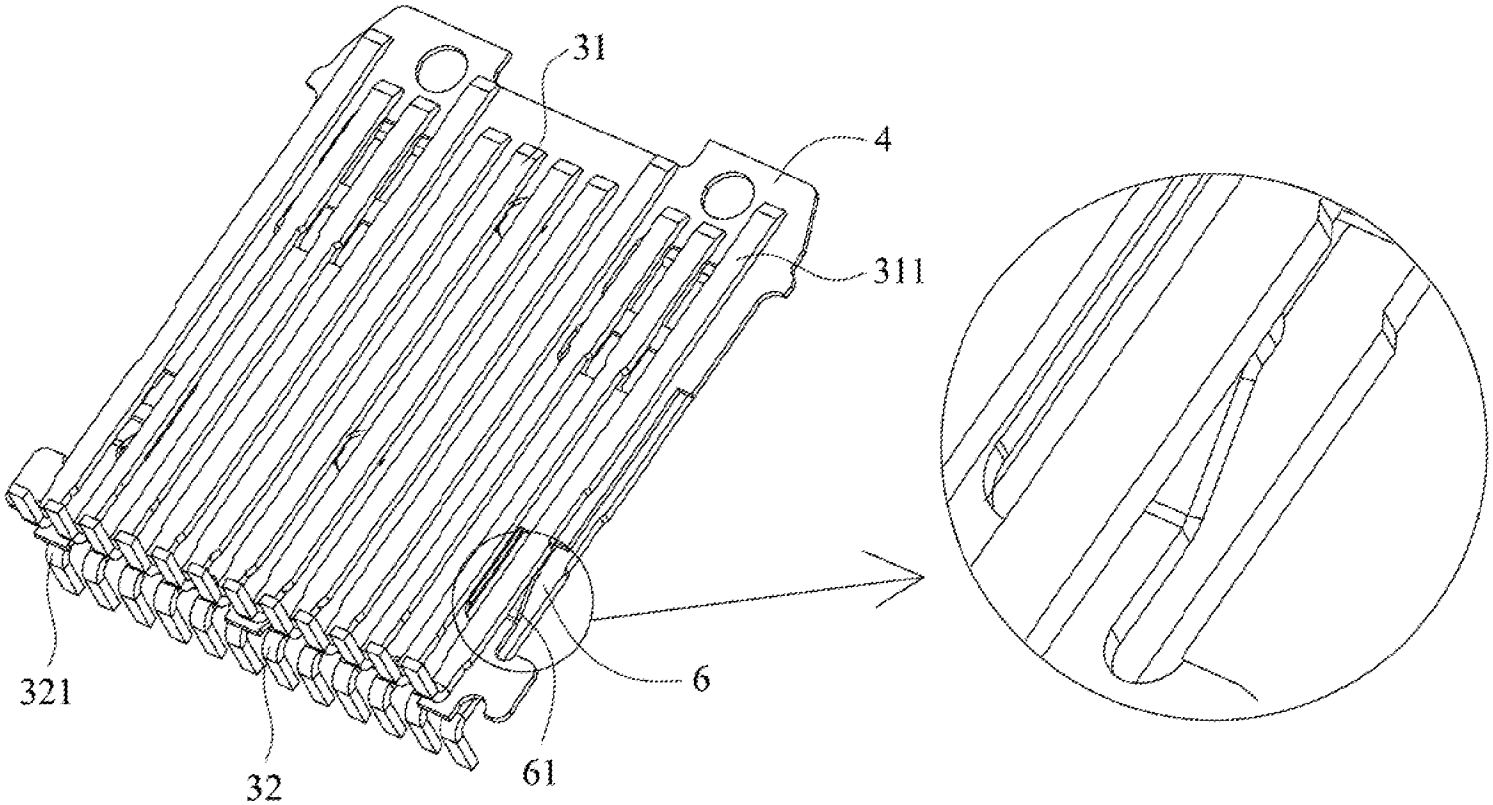
FIG. 2 is a schematic structure diagram showing a positional relationship between a shielding sheet and upper and lower terminal groups in FIG. 1.
Figure 3:
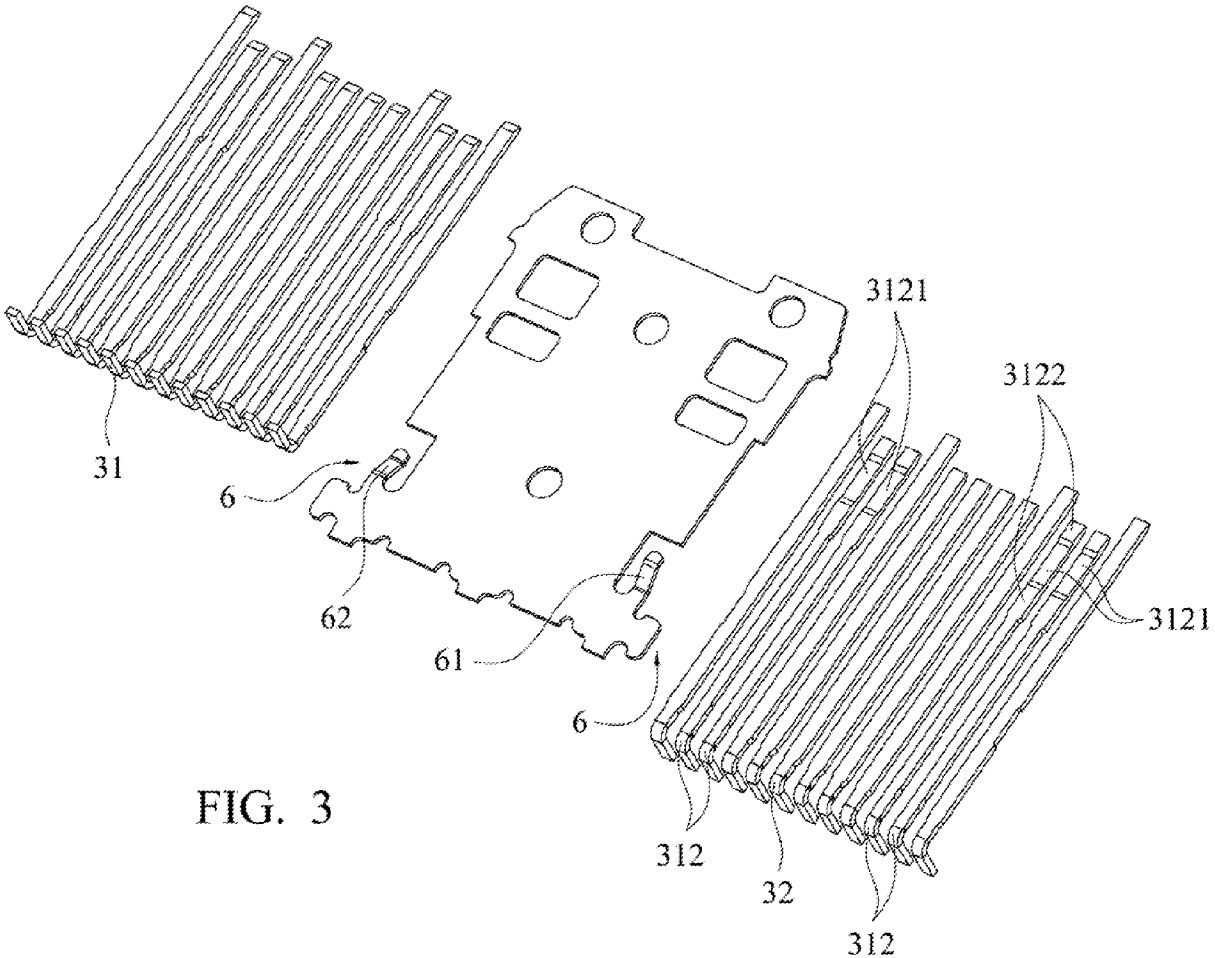
FIG. 3 is a schematic structure diagram of the shielding sheet and the upper and lower terminal groups in FIG. 1.

In the description of the present invention, it should be noticed, orientation or position relation indicated by terms such as "at the center of," "on," "below," "in front of," "behind," "at the left of," "at the right of" are orientation or position relation in connection with the figures. These terms are used to simplify the description of the present invention, and are not intended to indicate or suggest a specific configuration or orientation in operation for the device or element being described. Therefore, these terms cannot be construed as limitations to the present invention. In addition, terms such as "first" and "second" are used for descriptive purpose and shall not be construed as indicating or suggesting an element is more significant than another.

In the description of the present invention, it should be noticed, unless otherwise specified, terms such as "mounted," "joined," and "connected" should be construed in their broad sense. For example, "connected" includes "fixedly connected," "detachably connected," or "integrally connected"; it also includes "mechanically connected" or "electrically connected"; it further includes "directly connected," "connected via an intermediate element," or implies the inner connection of two elements. The meaning of each of these terms in the present invention shall be construed by the persons having ordinary skills in the art based on the specific context. In addition, unless otherwise specified, in the description of the present invention, "a plurality of," or "several" means two or more than two.

Referring to FIG. 1 to FIG. 5, an embodiment of a female connector for high-speed transmission with grounding is disclosed in FIG. 1 to FIG. 5. First referring to FIG. 1 to FIG. 3, the insulating body includes an upper insulating body 21, a middle insulating body 23, and a lower insulating body 22. The upper terminal group 31 is disposed on the upper insulating body 21. The lower terminal group 32 is disposed on the lower insulating body 22. The shielding sheet 4 is disposed in the middle insulating body 23. When the connector is operated, the shielding sheet 4 between the upper terminal group 31 and the lower terminal group 32 can reduce the electromagnetic interference between the terminal groups, thereby assuring the normal signal transmission and current transport for the terminal groups. A contact part 6 formed by directly processing the shielding sheet 4 is disposed on a portion of the shielding sheet, in which the portion corresponds to the ground terminals of the upper terminal group 31 and the lower terminal group 32. The contact part 6 is physically and electrically connected to the ground terminals to form an infinite ground, so that the ineffective current or noise can be conducted away. Furthermore, elements in the grounded shielding body are prevented from being interfered by the exterior electromagnetic field. Safety is guaranteed even if a large current flows into the connector. Finally, the upper insulating body 21 and the lower insulating body 22 are engaged with the middle insulating body 23 to form an integrated device, and the integrated device is disposed in case 1. The case 1 further includes welding foot 12 so as to mount the connector on a PCB.

To improve the shielding effect of the shielding sheet, the contact part 6 includes an upper spring plate 61 and/or a lower spring plate 62. The upper spring plate 61 is physically and electrically connected to the ground terminal 311 of the upper terminal group 31. The lower spring plate 62 physically and electrically contact the ground terminal 321 of the lower terminal group 32.

To improve the engagement between the upper insulating body 21 and the lower insulating body 22, a first shielding engaging case 81 and a second shielding engaging case 82 are further included. A first hook 811 is disposed on the first shielding engaging case 81. A second hook 821 is disposed on the second shielding engaging case 82. Meanwhile, A first hooking portion 231 and a second hooking portion 232 are disposed on the upper surface and the lower surface of the middle insulating body 23, respectively. The first shielding engaging case 81 is engaged with the upper surface of the middle insulating body 23, wherein the first hook 811 interlocks the corresponding second hooking portion 232 on the middle insulating body. Then, the second shielding engaging case 82 is engaged with the lower surface of the middle insulating body 23, wherein the second hook 821 interlocks the corresponding first hooking portion 231 on the middle insulating body 23.

Figure 4:
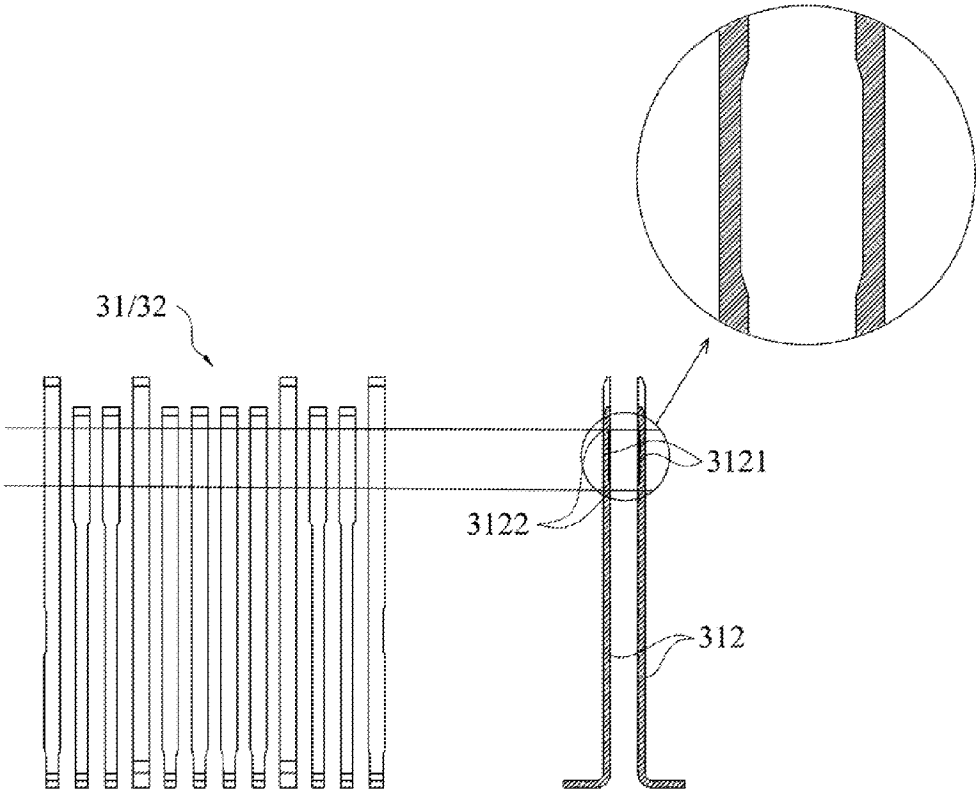
FIG. 4 is a schematic structure diagram of a high frequency terminal pair in FIG. 1.

Referring to FIG. 4, to achieve the high frequency transmission of the terminal group, the upper terminal group 31 and/or the lower terminal group 32 at least includes a high frequency terminal pair 312. The thickness of the contact portion 3121 of the high frequency terminal pair 312 is smaller than the thickness of a contact portion 3122 adjacent to the contact portion 3121.

Figure 5:
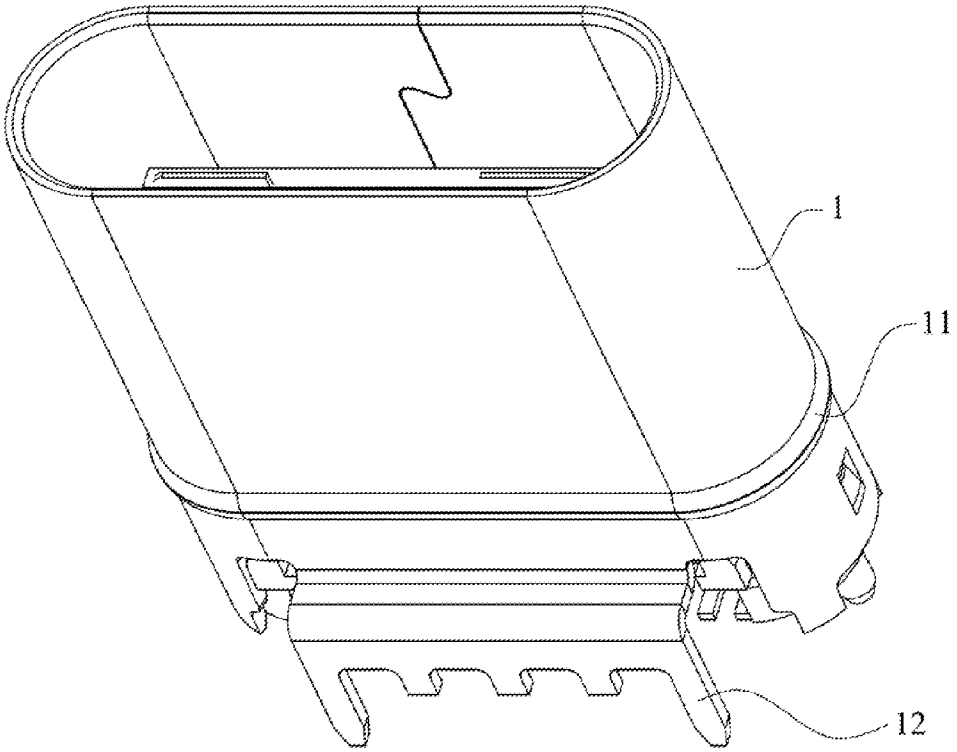
FIG. 5 is a schematic structure diagram of the structure of FIG. 1 after completion of the assembling.

Referring to FIG. 5, because a dovetail connection of the connector is a surface joint, after the connector is repeatedly plugged in and pulled out, the dovetail connection may be tilted or even popped out. Therefore, a rib 11 is disposed around the periphery of case 1. The rib 11 has a fixing function to make the case 1 more robust.

The present invention can be implemented as a second embodiment (not shown in the figures). The second embodiment is essentially the same as the first embodiment, except that the insulating body includes an upper insulating body and a lower insulating body, in which the upper terminal group is disposed on the upper insulating body, the lower terminal group is disposed on the lower insulating body, and the shielding sheet is disposed between the upper insulating body and the lower insulating body. The upper insulating body is engaged with the lower insulating body to form an integrated device.

The present invention can be implemented as the third embodiment (not shown in the figures). The second embodiment is essentially the same as the first embodiment, except that the insulating body is integrally formed. The upper terminal group and the lower terminal group are disposed on the insulating body, and the shielding sheet is inserted into the insulating body.

What is claimed is:

1. A female connector for high-speed transmission with grounding, the female connector comprising:

a case;

an insulating body disposed in the case, wherein the insulating body comprises an upper insulating body, a middle insulating body, and a lower insulating body;

an upper terminal group and a lower terminal group disposed in the insulating body, wherein the upper terminal group and/or the lower terminal group comprises at least a high frequency terminal pair, a thickness of a contact portion of the high frequency terminal pair is less than a thickness of a portion adjacent to the contact portion, wherein the upper terminal group is disposed on the upper insulating body, and the lower terminal group is disposed on the lower insulating body;

a shielding sheet disposed in the insulating body, wherein the shielding sheet is disposed in the middle insulating body, and the upper insulating body and the lower insulating body are engaged with the middle insulating body to form an integrated device;

a contact part directly processed from the shielding sheet, wherein the contact part is disposed on a portion of the shielding sheet corresponding to the ground terminals of the upper terminal group and the lower terminal group, and the contact part is physically and electrically connected to the ground terminal;

a first shieldinu engaging case;

a second shielding engaging case;

a first hook disposed on the first shielding engaging case;

a second hook disposed on the second shielding engaging case;

a first hooking portion disposed on an upper surface of the middle insulating, body; and a second hookint onion dis iosed on a lower surface of the middle insulatinu body, wherein the first shielding engaging case is engaged with the upper surface of the middle insulating body; the first hook interlocks with the corresponding second hooking portion on the middle insulating body; the second shielding engaging case is engaged with the lower surface of the middle insulating body; and the second hook interlocks with the corresponding first hooking ortiat on the middle insulating body.

2. The female connector of claim 1, wherein the contact part comprises an upper spring plate and/or a lower spring plate; the upper spring plate is physically and electrically connected to an upper ground terminal of the upper terminal group, and the lower spring plate is physically and electrically connected to with a lower Qround terminal of the lower terminal group.

3. The female connector of claim 2, wherein the insulating body comprises an upper insulating body, a middle insulating body, and a lower insulating body, wherein the upper terminal group is disposed on the upper insulating body; the lower terminal group is disposed on the lower insulating body; the shielding sheet is disposed in the middle insulating body; and the upper insulating body and the lower insulating body are engaged with the middle insulating body to form an integrated device.

4. The female connector of claim 1, wherein the insulating body comprises an upper insulating body and a lower insulating body, wherein the upper terminal group is disposed in the upper insulating body; the lower terminal group is disposed in the lower insulating body; the shielding sheet is disposed between the upper insulating body and the lower insulating body: and the upper insulating body and the lower insulating body are engaged to form an integrated device.

5. The female connector of claim 2, wherein the insulating body comprises an upper insulating body and a lower insulating body, wherein the upper terminal group is disposed in the upper insulating body; the lower terminal group is disposed in the lower insulating body; the shielding sheet is disposed between the upper insulating body and the lower insulating body; and the tipper insulating body and the lower insulating body are engaged to form an integrated device.

6. The female connector of claim 1, wherein the insulating body is integrally formed, and the shielding sheet is inserted into the insulating body.

7. The female connector of claim 2, wherein the insulating body is integrally formed, and the shielding sheet is inserted into the insulating body.

8. The female connector of claim 1, wherein a rib is disposed around the case.

9. The female connector of claim 2, wherein a rib is disposed around the case.

10. The female connector of claim 5, wherein a rib is disposed around the case.

* * * * *